US005472115A

United States Patent [19]

Whiton

[11] Patent Number: 5,472,115

[45] Date of Patent: Dec. 5, 1995

[54] BLISTERPACK OPENING TOOL

[76] Inventor: Joseph L. Whiton, 77 Joe Nestor Rd., Edgewood, N.M. 87015

[21] Appl. No.: 270,816

[22] Filed: Jul. 5, 1994

[51] Int. Cl.[6] ..... G07F 11/66

[52] U.S. Cl. ..... 221/25; 414/412

[58] Field of Search ..... 221/25, 30, 31, 221/131; 414/412

[56] References Cited

U.S. PATENT DOCUMENTS 4,733,797 3/1988 Haber ..... 221/25

5,009,561 4/1991 Lombardino et al. ..... 221/25

*Primary Examiner*—Kenneth Noland

*Attorney, Agent, or Firm*—DeWitt M. Morgan; Kevin Lynn Wildenstein

[57] ABSTRACT

A tool which dispenses a tablet from a blister type package, which package typically has a top blister portion and a bottom portion. The dispenser includes a first member having a flat surface for supporting the bottom portion of the blister package. This support surface has an opening therein which is larger than the table. A second member including a plunger for at least partially crushing the top portion and pushing the tablet through the bottom portion is also provided.

6 Claims, 2 Drawing Sheets

BLISTERPACK OPENING TOOL

FIELD OF THE INVENTION

This invention relates to devices for removing tablets, capsules or pills that are secured in pockets which include a plastic blister covering element.

BACKGROUND OF THE INVENTION

Many tablets, capsules and pills (hereinafter "tablets") are packaged on cards in individual or multiple tablet blister packages, typically consisting of a card backing and a bubble like plastic covering. The tablets are removed by, again typically, pushing on the plastic blister to collapse the blister and, simultaneously, push the tablet through the card backing. The area of the card backing supporting the tablet may be thinner or otherwise weaker than the surrounding area to facilitate rupture. Unfortunately for many individuals, particularly the elderly and infirm, the process of dislodging a tablet from its blister pack by hand is difficult, if not impossible.

There are a number of prior patents which disclose devices for dispensing tablets from blister type packages including: U.S. Pat. No. 4,733,797 to Haber; U.S. Pat. No. 5,038,968 to Albetski; U.S. Pat. No. 4,909,414 to Heath; U.S. Pat. No. 4,428,709 to Peters; and U.S. Pat. No. 5,009,561 to Lombardino, et al. Haber discloses what is described as a dosage sealing, monitoring and dispensing assembly for dispensing tablets from an elongated flexible strip. The dispersing is accomplished by a reciprocating plunger 30 which is actuated by, inter alia, lever arm 32. Albetski discloses a card support tray which is used in conjunction with a roller member for crushing the individual blister packs. The device disclosed by Heath is much more complicated, including the motor driven roller 30 which drives the blister pack into cutting blade 40. Likewise, the device of Peters is complicated, including a positioning die, a perforating die and a movable punch, all of which move together. Finally, Lombardino et al. discloses a dispenser for dispensing tablets into a small reaction chamber without contamination.

With the exception of Haber, none are designed for home use, and Haber's device is limited to tablets which are dispensed from a long flexible strip. The devise is not suitable for use with the flat rectangular multiple tablet blister packages currently in use, such as illustrated in Albetski, which come in a variety of sizes with a variety of different tablet sizes. Accordingly, the objects of the present invention are to provide a device which is: of simple construction; cheap to manufacture; hand held; has only two relatively moving parts; is easy to handle; provides the elderly and infirm with a mechanical advantage for crushing the blister portion of the package and pushing the tablet(s) through the base or card backing; and adaptable with a number of different blister/tablet sizes.

SUMMARY OF THE INVENTION

A tool which dispenses a tablet from a blister type package, which package typically has a top blister portion and a bottom portion. The dispenser includes a first member having a flat surface for supporting the bottom portion of the blister package. This support surface has an opening therein which is larger than the table to be dispensed. A second member includes a plunger for at least partially crushing the top portion and pushing the tablet through the bottom portion is also provided. The plunger includes a surface for engaging said top portion of the package. The first member is pivotally connected to the second member. At least one of the first and second members includes means for moving the plunger through an arc centered about the pivot, relative to the opening in the support surface, to engage the plunger surface with the top portion of the package, to at least partially crush the top portion of the package and push the tablet through the bottom portion and through the opening in the support surface. The means for moving the plunger through the arc is a first lever arm integral with the first member, and further includes a second lever arm integral with the second member. The tool further includes an insert positioned by the support surface and the opening in the support surface, whereby the tool can be used with smaller blister type packages and tablets.

DESCRIPTION OF THE PREFERRED EMBODIMENT

Figure 1:
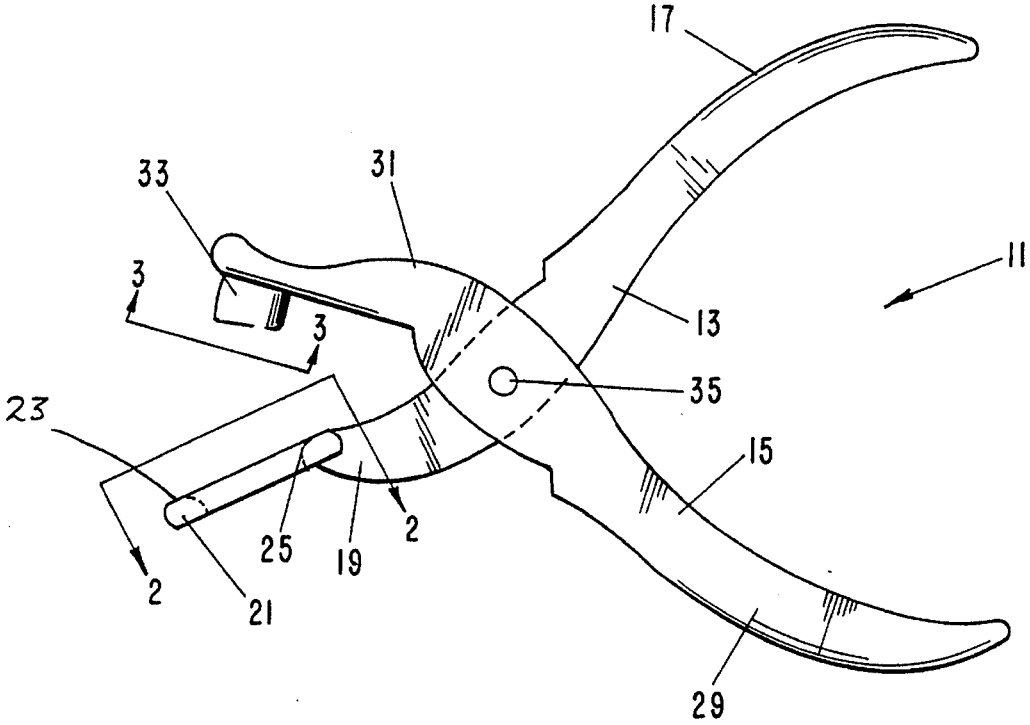
FIG. 1 is a side view of the preferred embodiment of the invention.
Figure 2:
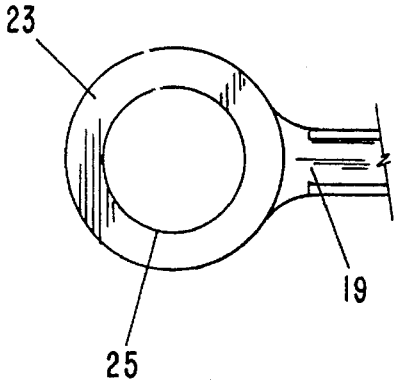
FIG. 2 is a top plain view taken along lines 2—2 of FIG. 1.
Figure 3:
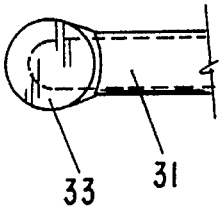
FIG. 3 is a top plain view taken along lines 3—3 of FIG. 1.

With reference to FIG. 1, blisterpack opening tool 11 includes a first lever arm 13 and a second lever arm 15. Arm 13 includes a handle position 17 and a tablet support portion 19 which, in time, includes a ring like member 21 having a support surface 23 and an opening 25. Ring 21 is integral with support portion 19. Similarly, lever arm 15 includes a second handle portion 29, and a plunger support portion 31 supporting plunger 33. Preferably plunger 33 is of hard rubber or plastic (such as nylon). Lever arms 13 and 15 are connected together by pivot 35. Preferably, the exterior surfaces of handle portions 17 and 29 are textured for improved hand gripping.

Figure 4:
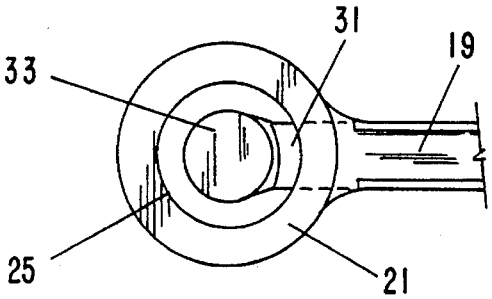
FIG. 4 is a bottom view showing the relationship between the plunger and tablet package support ring of the tool of FIG. 1.

As is evident from FIG. 4, the outside diameter of plunger 33 is smaller than the inside diameter of opening 25 so there can be no shearing action between these two parts during operation. Typically, plunger is 80% of the size of opening 25.

Figure 5:
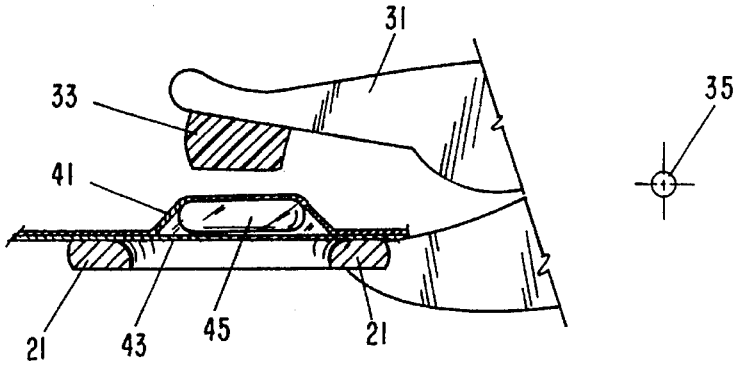
FIG. 5 is a partial sectional view showing the plunger as it just engages the top of the tablet blister.
Figure 6:
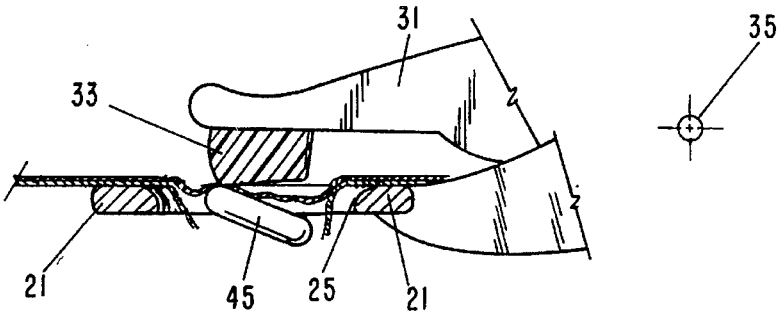
FIG. 6 is a partial sectional view of the embodiment of FIG. 1 showing the approximate position of the plunger as the tablet is ejected from its individual blister pack.

The operation of tool 11 is illustrated in FIGS. 5 and 6, wherein a typical tablet/blister package includes a clear plastic blister portion 41, a foil or paper backing 43 and a tablet 45 sandwiched therebetween. Backing 43 is positioned, by hand, on surface 23 of ring 21 so that tablet 45 is more or less centered over opening 25. The handle portions 17 and 29 are then squeezed together to move plunger 33 towards blister portion 41, to engage blister portion 41, then at least partially crush it to force tablet 45 through backing 43, as illustrated in FIG. 6.

Figure 7:
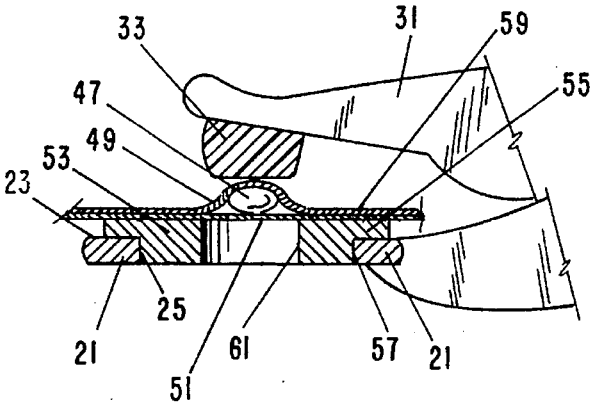
FIG. 7 is a partial sectional view of the embodiment of FIG. 1 with an insert for supporting a smaller tablet/blister package.

For smaller tablets such as illustrated at 47 in FIG. 7, encapsulated between blister 49 and backing 51, an insert ring 53 is provided. Ring 53 includes a shoulder 55 which rests on surface 23, a lower diameter 57 which is received within opening 25 and an upper surface 59. The diameter of opening 61 may be smaller than the diameter of plunger 33. The operation is otherwise the same as the embodiment of FIG. 1.

Figure 8:
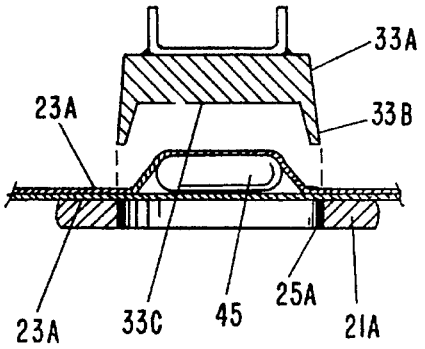
FIG. 8 is a partial sectional view showing an alternate plunger and ring for a shearing rather than pushing action.

FIG. 8 shows, in partial sectional view, a modification of tool 11, wherein the edge of the blister is sheared to release tablet 45, rather than crushed. The modified structure includes ring 21A, having a support surface 23A and an opening 25A. The edge between 23A and 25A is sharp. Ring 21A is attached to support 19. Plunger 33A attached to portion 31 has a circumference standing cutting edge 33B, having a diameter just slightly less than opening 25A. Plunger 33A is also recessed, as illustrated at 33C, to avoid crushing tablet 45. In operation, when plunger 33A moves downward relative to ring 21A, edge 33B shears both blister portion 41 and backing 43 to permit easy removal of tablet 45.

Whereas the drawings and accompanying description have shown and described the preferred embodiment of the present invention, it should be apparent to those skilled in the art that various changes may be made in the form of the invention without affecting the scope thereof.

I claim:

1. A tablet dispenser which dispenses a tablet from a blister type package, said package typically having a top blister portion and a bottom portion, said dispenser comprising:

(a) a first member, said first member including a flat surface for supporting said bottom portion of said package, said support surface having an opening therein, said opening being larger than said tablet;

(b) a second member, said second member including a plunger for at least partially crushing said top portion and pushing said tablet through said bottom portion, said plunger including a surface for engaging said top portion of said package;

(c) means for connecting said first member to said second member; and (d) means, integral with at least one of said first and second members, for moving said plunger through an arc centered about said connecting means and relative to said opening in said support surface to engage said plunger surface with said top portion of said package, at least partially crush said top portion of said package and push said tablet through said bottom portion and through said opening in said support surface.

2. The apparatus as set forth in claim 1, wherein said means for moving said plunger through said arc is a first lever arm integral with said first member, and further including a second lever arm integral with said second member.

3. The apparatus as set forth in claim 2, wherein said first lever arm and said second lever arm are arcuate in shape and spaced apart for easy hand gripping.

4. The apparatus as set forth in claim 1, wherein said plunger surface is smaller than said opening in said support surface, whereby at least a portion of said plunger can pass through said opening in said support surface.

5. The apparatus as set forth in claim 1, further including an insert positioned by said support surface and said opening in said support surface, said insert having an opening therein smaller than said opening in said support surface, whereby said dispenser can be used with smaller blister type packages.

6. A tablet dispenser which dispenses a tablet from a blister type package, said package typically having a top blister portion and a bottom portion, said dispenser consisting essentially of:

(a) a first member, said first member including a flat surface for supporting said bottom portion of said package, said support surface having an opening therein, said opening being larger than said tablet;

(b) a second member, said second member including a plunger for at least partially crushing said top portion and pushing said tablet through said bottom portion, said plunger including a surface for engaging said top portion of said package;

(c) means for connecting said first member to said second member; and (d) means, integral with at least one of said first and second members, for moving said plunger through an arc centered about said connecting means and relative to said opening in said support surface to engage said plunger surface with said top portion of said package, at least partially crush said top portion of said package and push said tablet through said bottom portion and through said opening in said support surface.

* * * * *